US007837577B2

(12) United States Patent
Evans

(10) Patent No.: US 7,837,577 B2
(45) **Date of Patent: *Nov. 23, 2010**

(54) GOLF CLUB HEAD WITH METAL INJECTION MOLDED SOLE

(75) Inventor: D. Clayton Evans, San Marcos, CA (US)

(73) Assignee: Callaway Golf Company, Carlsbad, CA (US)

( * ) Notice: Subject to any disclaimer, the term of this patent is extended or adjusted under 35 U.S.C. 154(b) by 0 days.

This patent is subject to a terminal disclaimer.

(21) Appl. No.: 12/689,139

(22) Filed: Jan. 18, 2010

(65) Prior Publication Data

US 2010/0120555 A1 May 13, 2010

Related U.S. Application Data

(63) Continuation of application No. 12/164,368, filed on Jun. 30, 2008, now Pat. No. 7,648,426.

(51) Int. Cl.
*A63B 53/04* (2006.01)

(52) U.S. Cl. ..... 473/345; 473/344; 473/349

(58) Field of Classification Search ..... 473/324–350
See application file for complete search history.

(56) References Cited

U.S. PATENT DOCUMENTS

| | | | |
|---|---|---|---|
| 4,214,754 | A | 7/1980 | Zebelean |
| 4,465,221 | A | 8/1984 | Schmidt |
| 5,447,309 | A | 9/1995 | Vincent |
| 5,582,553 | A | 12/1996 | Ashcraft et al. |
| 5,665,014 | A | 9/1997 | Sanford et al. |
| 5,785,605 | A | 7/1998 | Helmstetter |
| 5,911,102 | A | 6/1999 | Takahashi et al. |
| 5,985,208 | A | 11/1999 | Zedalis et al. |
| 5,989,493 | A | 11/1999 | LaSalle et al. |
| 6,027,686 | A | 2/2000 | Takahashi et al. |
| 6,074,310 | A | 6/2000 | Ota |
| 6,244,976 | B1 | 6/2001 | Murphy et al. |
| 6,322,746 | B1 | 11/2001 | LaSalle et al. |
| 6,334,817 | B1 | 1/2002 | Ezawa et al. |
| 6,350,407 | B1 | 2/2002 | Sakata et al. |
| 6,364,788 | B1 | 4/2002 | Helmstetter et al. |
| 6,409,612 | B1 | 6/2002 | Evans et al. |
| 6,478,842 | B1 | 11/2002 | Gressel et al. |
| 6,669,898 | B2 | 12/2003 | Gressel et al. |
| 6,739,983 | B2 | 5/2004 | Helmstetter et al. |
| 6,767,418 | B1 | 7/2004 | Zhang et al. |
| 7,396,296 | B2 | 7/2008 | Evans |
| 7,648,426 | B2 * | 1/2010 | Evans ..... 473/345 |

* cited by examiner

*Primary Examiner*—Alvin A Hunter
(74) *Attorney, Agent, or Firm*—Michael A. Catania; Sonia Lari

(57) ABSTRACT

A wood-type golf club head (20) with a main body (22) and a metal injection molded sole portion (26) is disclosed herein. The main body (26) has a face portion (30), a crown portion (24) a ribbon portion (28) and a bottom opening (31). The metal injection molded sole portion (26) is preferably brazed to the main body (22). The metal injection molded sole portion (26) preferably has a mass ranging from 45 grams to 110 grams. The metal injection molded sole portion (26) is preferably from 50 weight percent to 35 weight percent of the total mass of the wood-type golf club head (20).

5 Claims, 5 Drawing Sheets

FIG. 3
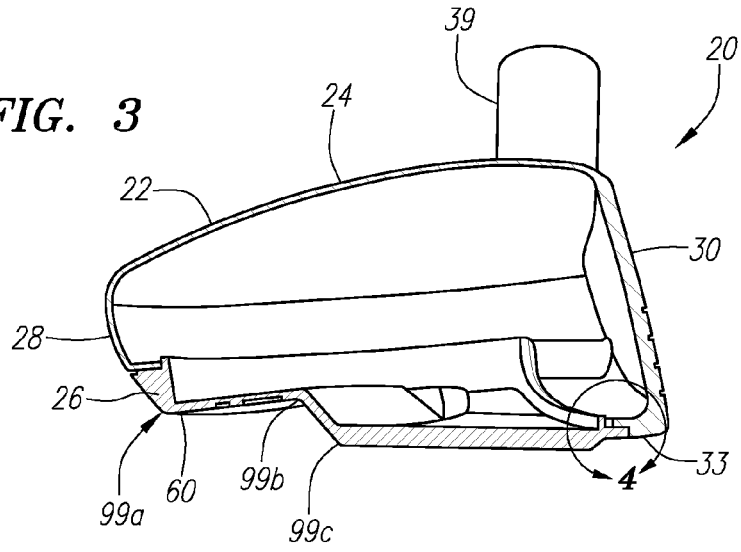
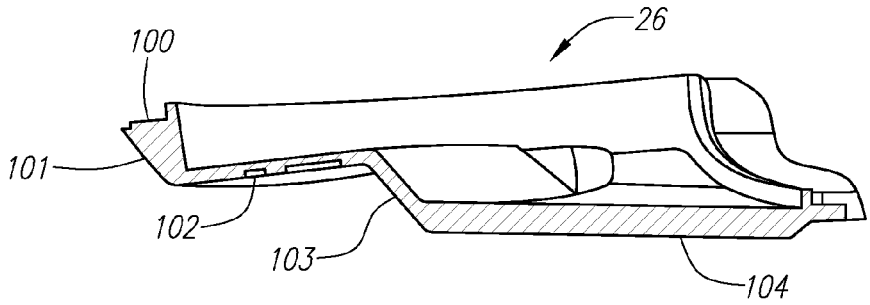
FIG. 3A
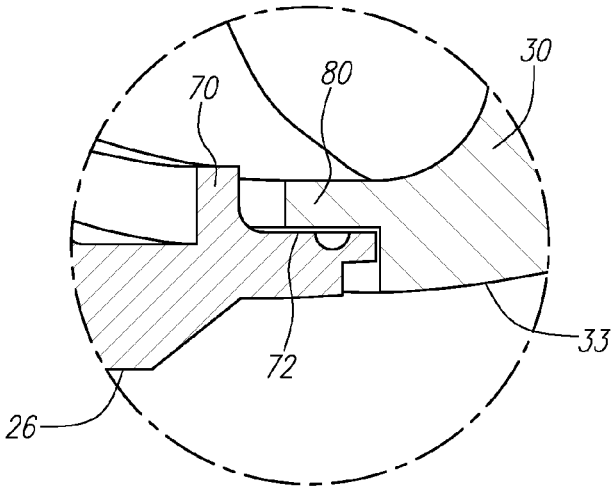
FIG. 4

GOLF CLUB HEAD WITH METAL INJECTION MOLDED SOLE

CROSS REFERENCES TO RELATED APPLICATIONS

The present application is a continuation application of U.S. patent application Ser. No. 12/164,368, filed on Jun. 30, 2008, which is a continuation application of U.S. patent application Ser. No. 11/275,968, filed on Feb. 7, 2006.

STATEMENT REGARDING FEDERALLY SPONSORED RESEARCH OR DEVELOPMENT

Not Applicable

BACKGROUND OF THE INVENTION

1. Field of the Invention

The present invention relates to a golf club head with a metal injection molded sole.

2. Description of the Related Art

Present day golf clubs are typically composed of titanium or steel, and either cast or forged. Various patents have disclosed the use of multiple material golf club heads, generally combining a metal with a non-metal. Various patents have disclosed the use of metal injection molding for golf clubs.

Sanford et al., U.S. Pat. No. 5,665,014, for a Metal Golf Club Head And Method Of Manufacture, discloses a golf club head with two components with at least one of the components composed of a metal injection molded material.

Gressel et al., U.S. Pat. No. 6,478,842, for a Preparation Of Articles Using Metal Injection Molding, discloses an entire golf club head composed of a metal injection molded material having a stainless steel and tungsten alloy composition.

Gressel et al., U.S. Pat. No. 6,669,898, for a Preparation Of Articles Using Metal Injection Molding, discloses forming an entire golf club head composed of a metal injection molded material having a stainless steel and tungsten alloy composition.

Zhang et al., U.S. Pat. No. 6,767,418, for a TI-ZR Type Alloy And Medical Appliance Formed Thereof, discloses a titanium-zirconium alloy that may be used for golf club components.

Sakata et al., U.S. Pat. No. 6,350,407, for a Process For Producing Sintered Product, discloses a process for metal injection molding.

LaSalle et al., U.S. Pat. No. 6,322,746, for a Co-Sintering Of Similar Materials, discloses a process of fusing two dissimilar material parts through use of co-sintering including a golf putter.

Takahashi et al., U.S. Pat. No. 6,027,686, for a Method Of Manufacturing Sintered Compact, discloses sintering a green body formed by metal injection molding.

LaSalle et al., U.S. Pat. No. 5,989,493, for a Net Shape Hastelloy X Made By Metal Injection Molding Using An Aqueous Binder, discloses metal injecting a Hastelloy X powder.

Zedalis et al., U.S. Pat. No. 5,985,208, for a Process For Debinding And Sintering Metal Injection Molded Parts Made With An Aqueous Binder, discloses metal injection molding a 17-4PH stainless steel alloy.

Takahashi et al., U.S. Pat. No. 5,911,102, for a Method Of Manufacturing Sintered Compact, discloses sintering a green body formed by metal injection molding.

Numerous techniques have been used for weighting golf club heads in order to gain better performance. In persimmon wood club heads, weights were attached to the sole in order to lower the center of gravity. The first metal woods had sufficient weight, however, the weight distribution deterred slightly from performance. The refinement of hollow metal woods with weighting on the sole improved upon the performance of these clubs. An example of such woods were the GREAT BIG BERTHA® HAWK EYE® drivers and fairway woods, developed by the Callaway Golf Company of Carlsbad, Calif., that used a tungsten screw in the sole of each titanium club head body to vary the weight of the golf club head.

Another example is set forth in Helmstetter et al., U.S. Pat. No. 6,364,788, for a Weighting System For A Golf Club Head, which discloses using a bismuth material within an internal cavity to add mass to a golf club head, particularly a fairway wood.

Yet a further example is set forth in Evans et al., U.S. Pat. No. 6,409,612, for a Weighting Member For A Golf Club Head, which discloses a weighting device composed of a polymer body with ports to allow for placement of high density members such as tungsten spheres.

Another example of additional weighting of a golf club head is set forth in U.S. Pat. No. 5,447,309, which discloses the use of three weights fixedly disposed within the interior of a club head to provide a selected moment of inertia for the club head. Yet another example is set forth in British Patent Application No. 2332149 for a Golf Club Head With Back Weighting Member, which discloses a weight pocket in the exterior rear of a wood for placement of epoxy inserts that vary in density.

An example of positioning mass in a golf club head for performance is disclosed in Helmstetter et al., U.S. Pat. No. 6,739,983, for a Golf Club Head With Customizable Center Of Gravity, which discloses a method and golf club head which allows a golfer to select a preferred center of gravity location for better ball striking.

A further example of positioning mass for performance is set forth in Helmstetter, U.S. Pat. No. 5,785,605 for a Hollow, Metallic Golf Club Head With Configured Medial Ridge, which discloses a golf club head with a center of gravity located in vertical alignment with a local zone defined by ridge on a sole of the golf club head.

The prior art fails to disclose a means for using a metal injection molded part for performance weighting of a golf club head.

BRIEF SUMMARY OF THE INVENTION

The present invention provides a golf club head with performance weighting of a metal injection molded component.

One aspect of the present invention is a wood-type golf club head having a main body and a sole portion. The main body has a face portion, a crown portion and a ribbon portion. The main body has a bottom opening. The main body is preferably composed of a stainless steel material and has a mass ranging from 100 grams to 150 grams. The sole portion is disposed over the bottom opening of the main body. The sole portion is composed of a metal injection molded material comprising stainless steel and tungsten. The metal injection material preferably has a density ranging from 7.9 g/cc to 12.5 g/cc, and a mass ranging from 45 grams to 100 grams. Another aspect of the present invention is a wood-type golf club head having a main body which is 50 weight percent to 65 weight percent of the total mass of the wood-type body and a sole portion which is 50 weight percent to 35 weight percent of the total mass of the wood-type body. The wood-type golf club head has a total mass ranging from 190 grams to 225 grams. The main body has a face portion, a crown portion and a ribbon portion. The main body also has a bottom opening. The main body is preferably composed of a stainless steel material. The sole portion is disposed over the bottom opening of the main body, and is composed of a metal injection molded material. The metal injection material has a density ranging from 7.9 g/cc to 12.5 g/cc.

Having briefly described the present invention, the above and further objects, features and advantages thereof will be recognized by those skilled in the pertinent art from the following detailed description of the invention when taken in conjunction with the accompanying drawings.

BRIEF DESCRIPTION OF THE SEVERAL VIEWS OF THE DRAWINGS

FIG. 3 is a cross-sectional view of a golf club head along line 3-3 of FIG. 2.

FIG. 3A is a cross-sectional view of a sole portion

FIG. 4 is an enlarged view of circle 4 of FIG. 3.

DETAILED DESCRIPTION OF THE INVENTION

Figure 1:
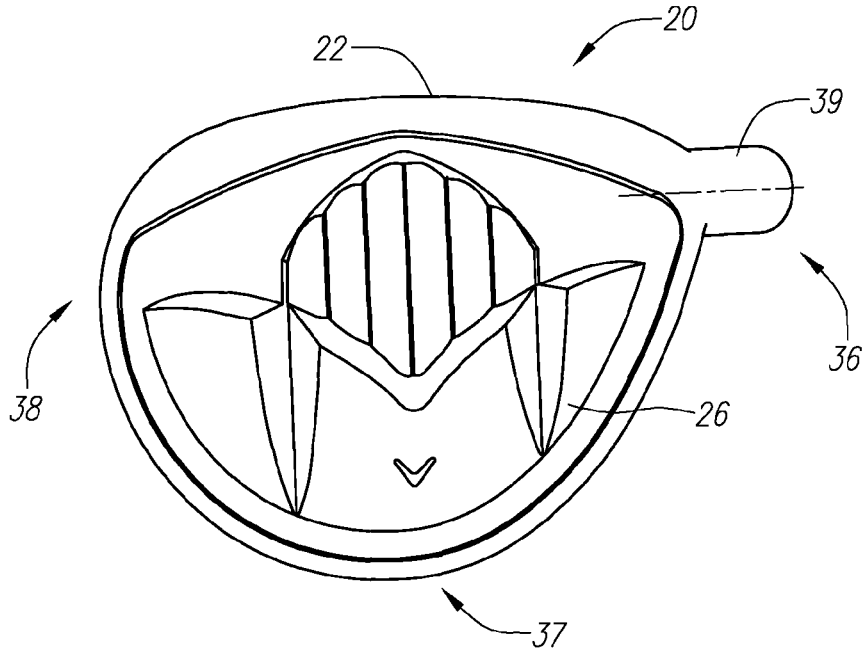
FIG. 1 is a bottom plan view of a golf club head.
Figure 2:
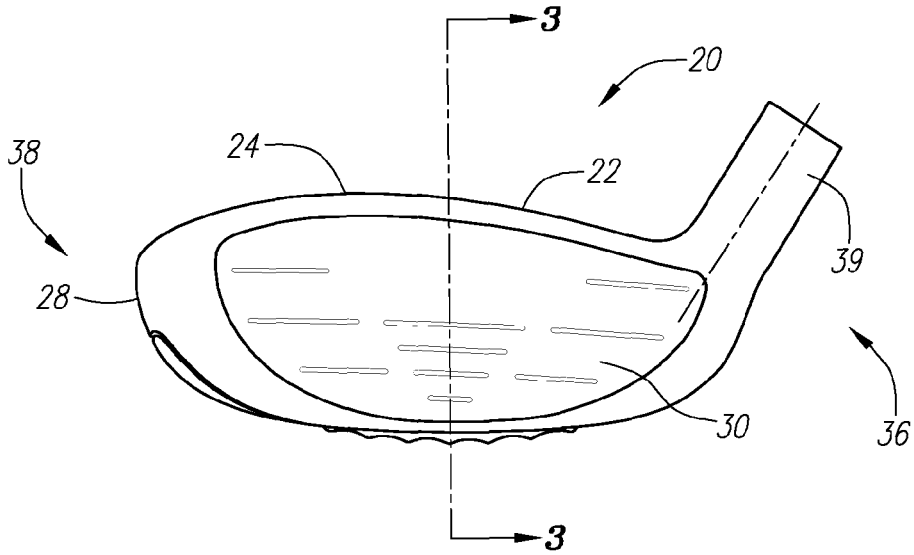
FIG. 2 is a front view of a golf club head.

As shown in FIGS. 1-5, a golf club head is generally designated 20. The golf club head 20 of FIGS. 1-5 is a fairway wood, however, the golf club head 20 of the present invention may alternatively be a driver. The golf club head 20 preferably has two main components: a main body 22 and a sole portion 26. The main body 22 is preferably composed of a metal material such as titanium, titanium alloy, stainless steel, or the like, and is most preferably composed of a cast stainless steel material. The body 22 is preferably cast from molten metal in a method such as the well-known lost-wax casting method. The metal for casting is preferably is composed of 17-4 steel alloy. Alternatively the body 22 is composed of a titanium or a titanium alloy such as 6-4 titanium alloy, alpha-beta titanium alloy or beta titanium alloy for forging, and 6-4 titanium for casting. Additional methods for manufacturing the body 22 include forming the body 22 from a flat sheet of metal, super-plastic forming the body 22 from a flat sheet of metal, machining the body 22 from a solid block of metal, electrochemical milling the body from a forged pre-form, and like manufacturing methods.

The golf club head 20 preferably has a volume from 100 cubic centimeters to 600 cubic centimeters, more preferably from 130 cubic centimeters to 475 cubic centimeters. When designed as a fairway wood, the golf club head 20 preferably has a volume ranging from 130 cubic centimeters to 300 cubic centimeters, and more preferably from 150 cubic centimeters to 275 cubic centimeters. The volume of the golf club head 20 will also vary between fairway woods (preferably ranging from 3-woods to eleven woods). When designed as a driver, the golf club head 20 preferably has a volume ranging from 300 cubic centimeters to 500 cubic centimeters, and more preferably from 350 cubic centimeters to 475 cubic centimeters.

The golf club head 20 preferably has a mass ranging from 90 grams to 250 grams, more preferably from 150 grams to 230 grams, and most preferably from 190 grams to 225 grams. The mass of the golf club head 20 will also vary between fairway woods (preferably ranging from 3-woods to eleven woods) and a driver.

In a preferred embodiment, the main body 22 has a crown portion 24, a ribbon portion 28, a face portion 30 with a bottom extension 33, and an opening 31. The golf club head 20 preferably has a hollow interior. The golf club head 20 has a heel end 36, a toe end 38 an aft end 37. A shaft, not shown, is placed within a hosel 39 at the heel end 36. The main body preferably has a mass ranging from 100 grams to 150 grams, and is most preferably 122 grams. The main body 22 preferably has a material volume ranging from 12.0 cubic centimeters to 20 cubic centimeters, and is most preferably approximately 16.0 cubic centimeters.

The face portion 30 of the main body 22 preferably has a thickness ranging from 0.050 inch to 0.125 inch, more preferably from 0.075 inch to 0.100 inch, and most preferably 0.080 inch to 0.090 inch. The ribbon portion 28 preferably has a thickness ranging from 0.020 inch to 0.050 inch, and most preferably approximately 0.030 inch. The crown portion 24 preferably has a thickness ranging from 0.020 inch to 0.050 inch, and most preferably approximately 0.030 inch.

Figure 5:
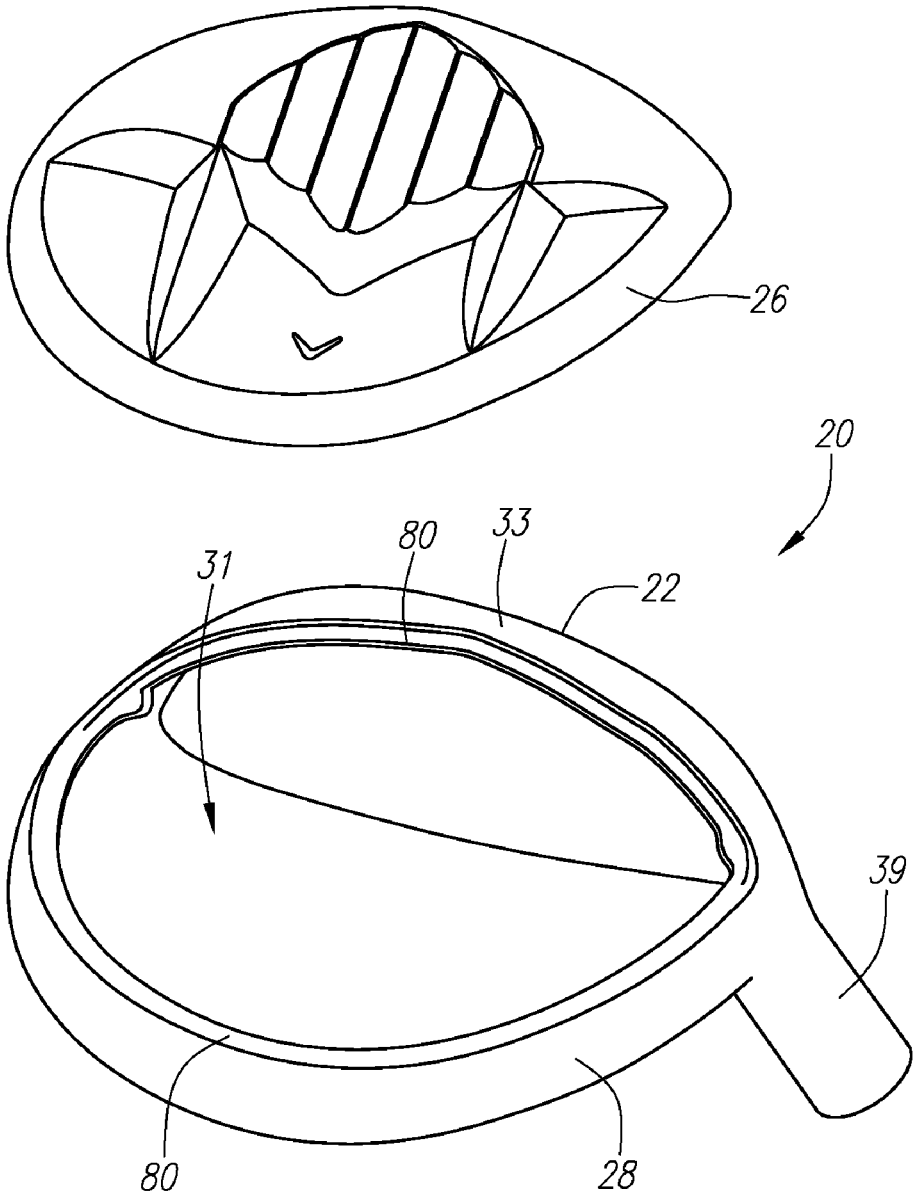
FIG. 5 is an exploded bottom view of preferred embodiment a golf club head.
Figure 5A:
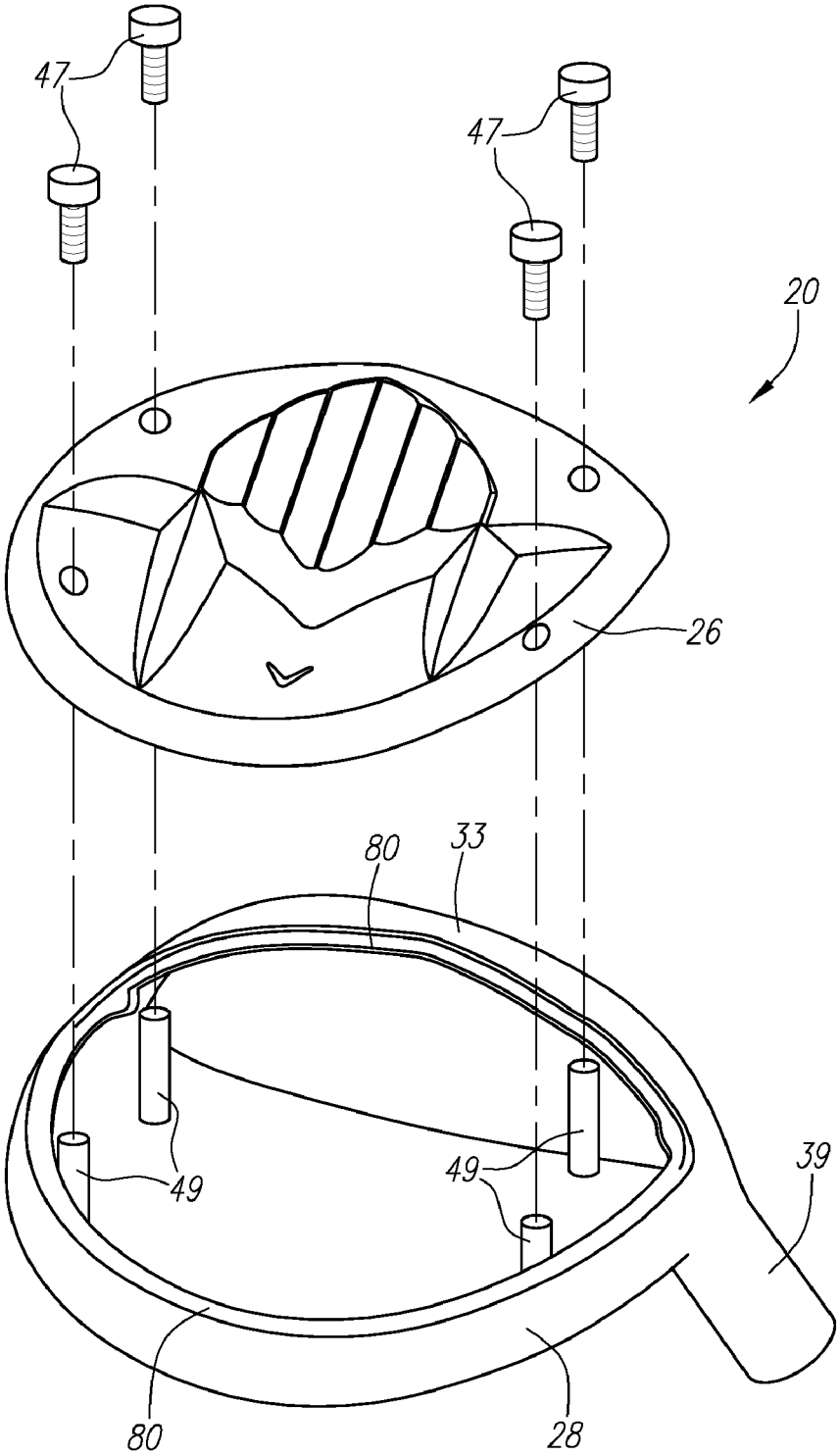
FIG. 5A is an exploded bottom view of an alternative embodiment of a golf club head.

The sole portion 26 is a separate component which is attachable to the main body 22 by known attachment means. In a preferred embodiment, the sole portion 26 is attached to the main body 22 using brazing. Alternatively as shown in FIG. 5A, the sole potion 26 is attached to the main body 22 utilizing a plurality of bolts 47, with each of the plurality of bolts 47 threaded into a corresponding threaded aperture 49 of a plurality of threaded apertures 49 of the main body 22. The attachment means allow for the use of dissimilar materials between the body 22 and sole portion 26.

The sole portion 26 is composed of a metal injection molded material. Preferably, the metal injection material comprises stainless steel and a tungsten alloy, and preferably has a density ranging from 7.90 grams per cubic centimeters ("g/cc") to 12.5 g/cc, and more preferably from 8.25 g/cc to 9.5 g/cc. The tungsten alloy preferably comprises tungsten and at least one of nickel, iron and copper. Metal injection molding powders are commercially available. CATAMOLD materials from BASF is one such metal injection molding powder.

The sole portion 26 preferably has a mass ranging from 45 grams to 100 grams, more preferably 70 grams to 95 grams, and most preferably 82 grams. The sole portion preferably has a volume ranging from 8.0 cubic centimeters to 12.0 cubic centimeters, and most preferably 10.0 cubic centimeters. The sole portion preferably has a thickness that ranges from 0.020 inch to 0.080 inch, more preferably from 0.030 inch to 0.070 inch, and even more preferably from 0.040 inch to 0.060 inch. Alternatively, in order to heel bias the golf club head 20, to better accommodate a golfer's swing properties, a heel region of the sole portion 26 preferably has a greater thickness than the entirety of the sole portion 26. The heel region may correspond to one of the surfaces discussed below in reference to sharp angle elevations. Further, in order to toe bias the golf club head 20, to better accommodate a golfer's swing properties, a toe region of the sole portion 26 preferably has a greater thickness than the entirety of the sole portion 26.

Figure 6:
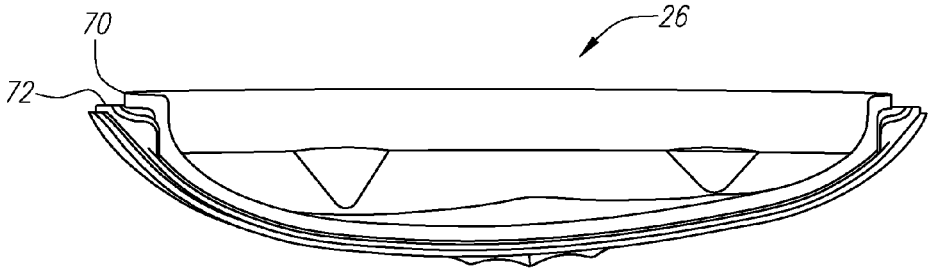
FIG. 6 is an isolated front plan view of a sole portion.
Figure 7:
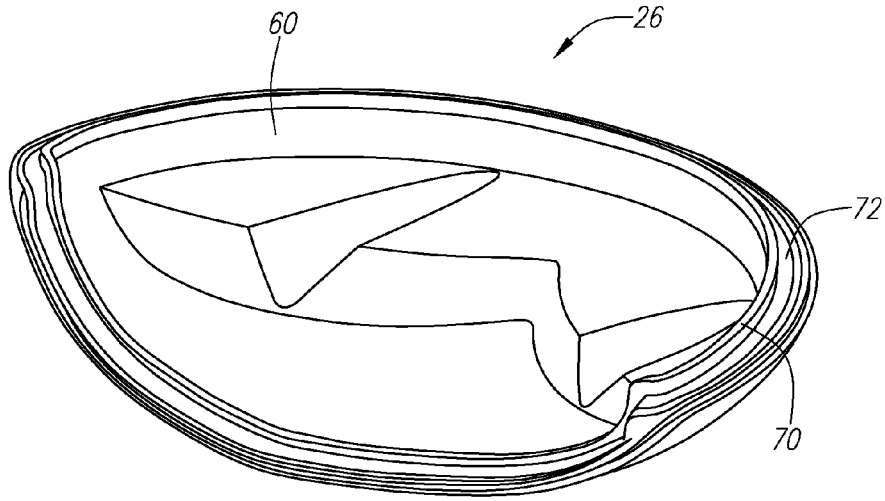
FIG. 7 is an isolated top view of a sole portion.

As shown in FIGS. 6 and 7, the sole portion 26 comprises an exterior wall 60, an interior flange 72 and an interior edge wall 70, which is substantially perpendicular to the interior flange 72. The interior flange 72 and the interior edge wall 70 preferably extend along the entire perimeter of the sole body 26 as shown in FIGS. 6 and 7. However, those skilled in the pertinent art will recognize that the interior flange 72 and interior edge wall 70 may not extend along the entire perimeter of the sole body 26.

As shown in FIG. 3, the main body 22 has a perimeter flange 80 which preferably extends along the entire perimeter of the main body 22. However, those skilled in the pertinent art will recognize that the perimeter flange 80 may not extend along the entire perimeter of the main body 22. The interior flange 72 and interior edge wall 70 of the sole portion 26, and the perimeter flange 80 of the main body 22 create a connection junction for brazing of the sole portion 26 to the main body 22.

In a preferred embodiment, the sole body 26 has a plurality of sharp angle elevations 99*a-c*, wherein the sharp angle ranges from 70 degrees to 90 degrees. As shown in FIG. 3A, the sole portion 26 is partitioned into a plurality of surfaces to demonstrate the sharp angle feature of the sole body 26, which is made possible through the use of metal injection molding. A first surface 100 is substantially perpendicular to a second surface 101 which is substantially perpendicular to a third surface 102 which is substantially perpendicular to a fourth surface 103 which is substantially perpendicular to a fifth surface 105. Metal injection molding allows for the sharp angle elevation changes between the surfaces.

In general, the moment of inertia, Izz, about the Z axis for the golf club head 20 of the present invention will range from 1900 g-cm$^2$ to 3000 g-cm$^2$, preferably from 1990 g-cm$^2$ to 2800 g-cm$^2$, and most preferably from 1990 g-cm$^2$ to 2600 g-cm$^2$. The moment of inertia, Iyy, about the Y axis for the golf club head 20 of the present invention will range from 900 g-cm$^2$ to 1700 g-cm$^2$, preferably from 950 g-cm$^2$ to 1500 g-cm$^2$, and most preferably from 965 g-cm$^2$ to 1300 g-cm$^2$.

From the foregoing it is believed that those skilled in the pertinent art will recognize the meritorious advancement of this invention and will readily understand that while the present invention has been described in association with a preferred embodiment thereof, and other embodiments illustrated in the accompanying drawings, numerous changes, modifications and substitutions of equivalents may be made therein without departing from the spirit and scope of this invention which is intended to be unlimited by the foregoing except as may appear in the following appended claims. Therefore, the embodiments of the invention in which an exclusive property or privilege is claimed are defined in the following appended claims.

I claim as my invention:

1. A fairway wood-type golf club head comprising:

a main body having a bottom opening, the main body composed of a stainless steel material, the main body having a material volume ranging from 12.0 cubic centimeters to 20.0 cubic centimeters, the main body having a mass ranging from 100 grams to 150 grams; and a sole portion disposed over the bottom opening of the main body, the sole portion composed of a metal injection material comprising stainless steel and a tungsten alloy and having a density ranging from 7.9 g/cc to 12.5 g/cc, the sole portion having a material volume ranging from 6.0 cubic centimeters to 12.0 cubic centimeters, the sole body having a mass ranging from 45 grams to 100 grams, the sole portion having a heel section, wherein the heel section has a thickness greater than the thickness of the entirety of the sole portion;

wherein the fairway-type golf club head has a volume ranging from 150 cubic centimeters to 275 cubic centimeters and wherein the fairway wood-type golf club head has a total mass ranging from 150 grams to 230 grams.

2. The fairway wood-type golf club head according to claim 1 wherein the sole portion is brazed to the main body.

3. The fairway wood-type golf club head according to claim 1 wherein the sole portion comprises an exterior wall, an interior flange and an interior edge wall, wherein the main body further comprises a perimeter flange, and wherein the perimeter flange of the main body engages the interior flange of the sole portion.

4. The fairway wood-type golf club head according to claim 1 wherein the sole portion is attached with threaded or non-threaded fasteners to the main body.

5. A fairway wood-type golf club head comprising:

a main body having a bottom opening, the main body composed of a stainless steel material, the main body having a material volume ranging from 12.0 cubic centimeters to 20.0 cubic centimeters, the main body having a mass ranging from 100 grams to 150 grams; and a sole portion disposed over the bottom opening of the main body, the sole portion composed of a metal injection material comprising stainless steel and a tungsten alloy and having a density ranging from 7.9 g/cc to 12.5 g/cc, the sole portion having a material volume ranging from 6.0 cubic centimeters to 12.0 cubic centimeters, the sole body having a mass ranging from 45 grams to 100 grams, the sole portion having a plurality of sharp angle elevations, wherein the sharp angle ranges from 70 degrees to 90 degrees for each plurality of sharp angle elevations relative to at least one other of the plurality of sharp angle elevations;

wherein the fairway-type golf club head has a volume ranging from 150 cubic centimeters to 275 cubic centimeters and wherein the fairway wood-type golf club head has a total mass ranging from 150 grams to 230 grams.

* * * * *